US010107036B2

(12) United States Patent
Bowley et al.

(10) Patent No.: US 10,107,036 B2
(45) Date of Patent: Oct. 23, 2018

(54) ROTARY TRANSFORMER FOR POWER TRANSMISSION ON A DRILLING RIG SYSTEM AND METHOD

(71) Applicant: Nabors Drilling Technologies USA, Inc., Houston, TX (US)

(72) Inventors: Ryan Thomas Bowley, Calgary (CA); Edgar Fernando Yajure, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 502 days.

(21) Appl. No.: 14/614,267

(22) Filed: Feb. 4, 2015

(65) Prior Publication Data

US 2016/0222731 A1 Aug. 4, 2016

(51) Int. Cl.

| | |
|---|---|
| ***E21B 3/02*** | (2006.01) |
| ***E21B 47/12*** | (2012.01) |
| ***E21B 17/02*** | (2006.01) |

(52) U.S. Cl.

CPC ..... *E21B 3/02* (2013.01); *E21B 17/028* (2013.01); *E21B 47/122* (2013.01)

(58) Field of Classification Search

CPC ..... E21B 47/122; E21B 17/028; E21B 3/02
See application file for complete search history.

(56) References Cited

U.S. PATENT DOCUMENTS

2016/0145954 A1* 5/2016 Helms ..... E21B 19/06 175/57

FOREIGN PATENT DOCUMENTS

| | | |
|---|---|---|
| DE | 19914395 A1 | 10/2000 |
| EP | 0510926 A2 | 10/1992 |
| EP | 1913228 B1 | 6/2010 |

* cited by examiner

*Primary Examiner* — D. Andrews
(74) *Attorney, Agent, or Firm* — Enrique Abarca; Abel Law Group, LLP

(57) ABSTRACT

The present disclosure is directed to a drilling system. The drilling system includes drill string actuation mechanism having a first component and a second component configured to be rotated relative to the first component by a driving mechanism of the drill string actuation mechanism. The drilling system also includes a rotary transformer having a power input winding and a rotating power output winding. The power input winding is configured to be coupled to a power source and to the first component of the drill string actuation mechanism, and the rotating power output winding is configured to be coupled to the second component of the drill string actuation mechanism.

20 Claims, 7 Drawing Sheets

ROTARY TRANSFORMER FOR POWER TRANSMISSION ON A DRILLING RIG SYSTEM AND METHOD

BACKGROUND

Embodiments of the present disclosure relate generally to the field of drilling and processing of wells. More particularly, present embodiments relate to a system and method for power transmission to drilling rig components.

During a drilling process via a drilling rig, a drill string (e.g., a tubular of the drill string) may be supported and hoisted about the drilling rig by a hoisting system for eventual positioning of the drill string down hole in a well (e.g., a wellbore). As the drill string is lowered into the well, a drive system may rotate the drill string to facilitate drilling. At the end of the drill string, a bottom hole assembly (BHA) and a drill bit may press into the ground to drill the wellbore.

Generally, a top drive (e.g., of the drive system) imparts rotation to the drill string to facilitate maneuvering the drill string in and out of the wellbore. For example, the top drive causes the drill string to rotate as the drill string contacts the walls of the wellbore, such that the rotational energy of the drill string overcomes the frictional force between the wellbore and the drill string. Further, components proximate to a drill floor of the drilling rig may rotate one or more sections of tubular of the drill string for engaging or disengaging the tubular sections with one another and/or with saver subs disposed between each section of tubular. In some instances, rotation of the drill string via the top drive (or components proximate to the top drive) or via components proximate to the drill floor frustrates power transmission to various components (e.g., rotating components) of the drill string. Accordingly, it is now recognized that improved power transmission to components of the drilling rig is desired.

BRIEF DESCRIPTION

In a first embodiment, a drilling system includes a drill string actuation mechanism having a first component and a second component configured to be rotated relative to the first component by a driving mechanism of the drill string actuation mechanism. The drilling system also includes a rotary transformer having a power input winding and a rotating power output winding. The power input winding is configured to be coupled to a power source and to the first component of the drill string actuation mechanism, and the rotating power output winding is configured to be coupled to the second component of the drill string actuation mechanism.

In a second embodiment, a power transmission system for a drilling rig includes a rotary transformer. The rotary transformer includes a stationary input winding of the rotary transformer coupled to a stationary component of a drill string actuator of the drilling rig. The rotary transformer also includes a rotating output winding coupled to a rotating component of the drill string actuator. The stationary input winding of the rotary transformer is configured to electrically couple with a power source to receive a first electric current and generate a magnetic flux through the rotating power output winding to induce a second electric current in the rotating output winding without physical contact between the stationary input winding and the rotating output winding In a third embodiment, a method for providing power to a component on a drilling rig includes transmitting a first electric current from a power source to a primary coil coupled to a first component of the drilling rig to generate a magnetic flux through the primary coil and through a secondary coil disposed proximate to the primary coil. The secondary coil is coupled to a first rotating component of the drilling rig and the magnetic flux through the secondary coil induces a second electric current in the secondary coil. The method further includes transmitting the second electric current from the secondary coil to the first rotating component or to a second rotating component configured to rotate with the first rotating component.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
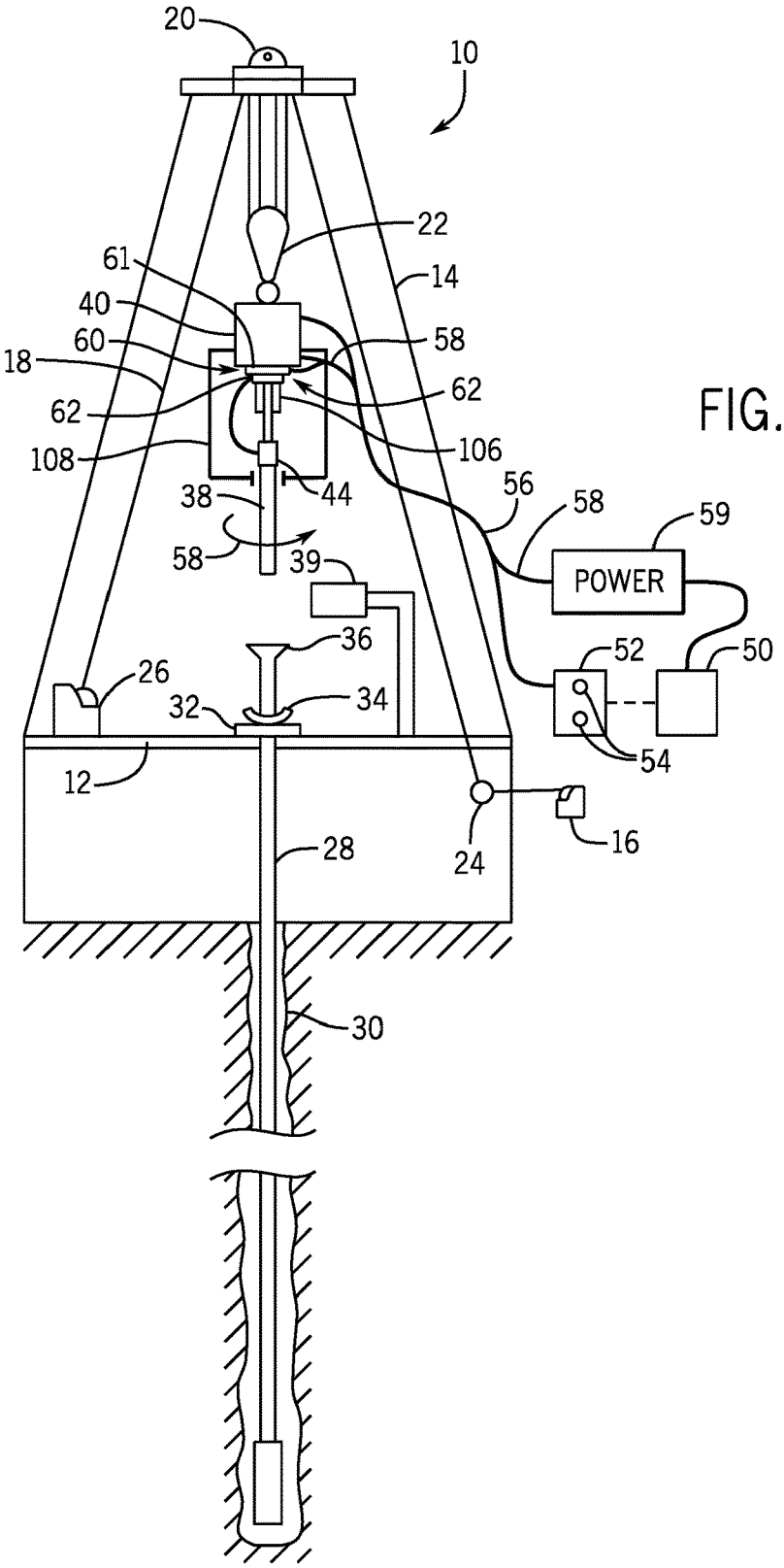
FIG. 1 is a schematic view of an embodiment of a drilling rig having rotary transformers for power transmission, in accordance with an aspect of the present disclosure.

Various drilling techniques can be utilized in accordance with embodiments of the present disclosure. In conventional oil and gas operations, a well (e.g., wellbore) is typically drilled to a desired depth with a drill string, which includes tubular (e.g., drill pipe or collars) and a drilling bottom hole assembly (BHA). During a drilling process, the drill string or a portion of the drill string (e.g., a tubular of the drill string) may be supported and hoisted about a drilling rig by a hoisting system for eventual positioning down hole in the wellbore. As the drill string is lowered into the well, a drive system may rotate the drill string to facilitate drilling. For example, rotation of the drill string enables the drill string to overcome frictional forces applied to the drill string by walls of the wellbore. The drive system typically includes a rotational feature (e.g., a drive shaft or quill) that transfers torque to the drill string from a top drive or the like (e.g., components proximate to the top drive). For example, the top drive may include a motor that generates torque and may utilize the quill to transfer the torque to the drill string, in some embodiments through a saver sub disposed between the quill and the drill string. The saver sub is a piece of tubular threaded to the quill which serves, in some embodiments, as a sacrificial component such that the threads of the quill do not constantly wear out. The saver sub may also include a mud saver valve that selectively enables the flow of drilling fluid (e.g., mud) through the drill string and into the wellbore. Further still, the saver sub may include one or more sensors that detect various drilling parameters, such as torque in the drill string. It should be noted that the mud saver valve and the sensors may be in-board components of the saver sub, or may be separate components.

As described above, the drill string may include multiple sections of tubular threadably engaged either directly or via respective saver subs disposed between sections of tubular. In some embodiments, the sections of tubular may be threadably engaged with one another (or the saver sub) proximate to a drill floor of the drilling rig. For example, an iron roughneck, a joint rotation system (e.g., a differential speed disengage), or a similar component may be positioned proximate to the drill floor and may be utilized to engage or disengage a section of tubular with another section of tubular, or with a saver sub or a tool joint, as described above. The joint rotation system (e.g., differential speed disengage) may impart different rotational forces to each section of tubular being engaged or disengaged, causing the sections of tubular to rotate at different speeds, thereby facilitating threading or unthreading, respectively, of the connection. In general, the rotation imparted to the drill string via the top drive and/or via the components proximate to the drill floor is enabled by power transmission from a service loop of the drilling rig. For example, the service loop may include a power source that powers the top drive to enable the top drive to generate the torque needed to turn the drill string (e.g., via the quill and, in some embodiments, the saver sub).

In some embodiments, certain other components of the drill string may also utilize electric power (e.g., provided by the power source) for various steps in the drilling process. For example, an inboard hydraulic power unit may utilize electric power for providing high pressure fluid to the drill string. Further, certain saver subs may include torque detection features that may utilize electric power. Further still, mud valves (e.g., mud valves which selectively enable or disable fluid circulation in portions of the drill string) may utilize electric power for opening and closing of the valve mechanism. Unfortunately, power transmission from the stationary service loop to rotating components of the drill string may be frustrated by the fact that the power transmission components (e.g., wiring, controllers, electric leads) may become entangled as the drill string rotates.

Thus, in accordance with present embodiments, one or more rotary transformers (e.g, contactless rotary transformers) are disposed on certain components of the drilling rig (e.g., the top drive, components proximate to the top drive, the drill floor, and/or components proximate to the drill floor) to enable contactless power transmission from the service loop to the rotating drill string. For example, the rotary transformer includes a stationary power input component (e.g., primary or stationary winding of coil) coupled to a stationary component of the drilling rig (e.g., a shroud of the top drive), and a rotating power output component (e.g., secondary or rotating winding of coil) coupled to a rotating component of the drilling rig (e.g., the quill). The rotating power output component of the rotary transformer is not rigidly coupled to the stationary power input component of the rotary transformer.

The stationary power input component and the rotating power output component each include a coil winding wound annularly about a longitudinal axis extending through the stationary power input component and the rotating power output component. As electric current is provided to the stationary power input component via the power source (e.g., via the service loop), magnetic flux is generated through, for example, the centers of the stationary power input component and the rotating power output component (e.g., along and proximate to the longitudinal axis). The magnetic flux proximate to the rotating power output component enables inductance of electric current in the rotating power output component. Thus, the rotating power output component includes an electric charge that may be transmitted to rotating components of the drill string to power the rotating components. The electric charge is induced without any physical contact between the rotating power output component and the stationary power input component of the rotary transformer. This enables the rotating power output component to supply power to various rotating components of the drill string without power transmission components (e.g., wiring or the like) becoming entangled. Further, because the stationary and rotating components of the rotary transformer do not physically contact one another, frictional heat is blocked, thereby reducing or blocking spark generation between the components. Further still, it should be noted that, in some embodiments, the rotary transformer may be utilized in accordance with the description above to transfer data (e.g., signals indicative of torque) from the rotary components to the stationary components (e.g., to a controller that controls the service loop), or vice versa. These and other features, in accordance with present embodiments, will be described in detail below.

Turning now to the figures, FIG. 1 is a schematic view of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another length of tubular 38 may be added. The drill string 28 may include multiple sections of threaded tubular 38 that are threadably coupled together using, for example, an iron roughneck 39, illustrated schematically in FIG. 1. It should be noted that present embodiments may be utilized with drill pipe, casing, or other types of tubular, as well as with other threadably engaged components of the drilling rig 10.

During operation, a top drive 40, hoisted by the traveling block 22, may engage and position the tubular 38 above the wellbore 30. The top drive 40 may then lower the coupled tubular 38 into engagement with the stump 36 and rotate the tubular 38 such that it connects with the stump 36 and becomes part of the drill string 28. Specifically, the top drive 40 includes a quill 42 to turn the tubular 38 or other drilling equipment. After setting or landing the drill string 28 in place such that the male threads of one section (e.g., one or more joints) of the tubular 38 and the female threads of another section of the tubular 38 are engaged, the two sections of the tubular 38 may be joined by rotating one section relative to the other section (e.g., in a clockwise direction) such that the threaded portions tighten together. Thus, the two sections of tubular 38 may be threadably joined.

Other portions of the drilling rig 10 may also be threadably joined. For example, the quill 42 may be coupled to a saver sub 44 and the saver sub 44 may be coupled to the tubular 38, such that torque is transmitted from the top drive 40 through the quill 42 and through the saver sub 44 to the tubular 38 for engaging the tubular 38 with the drill string 28 (e.g., at the stump 36). The saver sub 44 is included between the quill 42 and the tubular 38 to preserve the integrity of the threads on the quill 42. This generally makes the threads of the saver sub 44 coupled to the tubular 38 more likely to fail than the threads of the quill 42.

During other phases of operation of the drilling rig 10, the top drive 40 may be utilized to disconnect and remove sections of the tubular 38 from the drill string 28. As the drill string 28 is removed from the wellbore 30, the sections of the tubular 38 may be detached by disengaging the corresponding male and female threads of the respective sections of the tubular 38 via rotation of one section relative to the other in a direction opposite that used for coupling.

While FIG. 1 illustrates the drilling rig 10 in the process of adding the tubular 38 to the drill string 28, as would be expected, the drilling rig 10 also functions to drill the wellbore 30. Indeed, the drilling rig 10 includes a drilling control system 50 in accordance with the present disclosure. The control system 50 may coordinate with certain aspects of the drilling rig 10 to perform certain drilling techniques. For example, the drilling control system 50 may control and coordinate rotation of the drill string 28 via the top drive 40 and supply of drilling mud to the wellbore 30 via a pumping system 52. The pumping system 52 includes a pump or pumps 54 and conduits or tubing 56, which may include connection features such as a goose neck of the top drive 40. The pumps 54 are configured to pump drilling fluid down hole via the tubing 56, which communicatively couples the pumps 52 to the wellbore 30. In the illustrated embodiment, the pumps 54 and tubing 56 are configured to deliver drilling mud to the wellbore 30 via the top drive 40. Specifically, the pumps 54 deliver the drilling mud to the top drive 40 via the tubing 56, the top drive 40 delivers the drilling mud into the drill string 28 via a passage through the quill 42, and the drill string 28 delivers the drilling mud to the wellbore 30 when properly engaged in the wellbore 30. Further, the saver sub 44 may act as a mud saver valve by selectively enabling or disabling the flow of mud from the quill 42 to the drill string 28 below the quill 42. Alternatively, a separate component may act as the mud saver valve. The mud may be routed through the drill string 28 and out of the drill string 28 into an area between the drill string 28 and the sides of the well 30. Thus, the mud may reduce frictional engagement of the drill string 28 with the sides of the well 30, which is also addressed via rotation of the drill string 28 from the top drive 40, as previously described. In other words, the control system 50 may control rotation of the drill string 28 and supply of the drilling mud by controlling operational characteristics of the top drive 40 and pumping system 52 based on inputs received from sensors and manual inputs.

In addition to supplying the mud to the top drive 40 and the drill string 28, the tubing 56 may include electrical wiring 58 that extends between a power source 59 of (or coupled to) the control system 50. The electrical wiring 58 may be integral with the tubing 56, or the electrical wiring 58 may be a separate component from the tubing 56 and may extend between the power source 59 and the top drive 40. In accordance with embodiments of the present disclosure, the electrical wiring 58 may extend from the power source 59 directly to the top drive 40. The electrical wiring 58 also extends to a rotary transformer 60 of the drilling rig 10. The rotary transformer 60 may include a stationary component 61 coupled to, for example, the top drive 40 and the electrical wiring 58. The illustrated rotary transformer 60 may also include a rotating component 62 coupled to, for example, the quill 42. Generally, the stationary component 61 and the rotating component 62 of the rotary transformer 60 do not physically contact one another. However, via magnetic flux and electrical induction (e.g., as described below), the rotary transformer 60 transfers power from the stationary component 61 to the rotating component 62, enabling the rotating component 62 to provide power to various rotating components of the drill string 28 (e.g., tubular 38, the saver sub 44, a mud valve (which, in some embodiments, may be integral to the saver sub 44), a wireless torque turn sensor (which, in some embodiments, may be integral to the saver sub 44), or some other component). It should be noted that the drilling rig 10 may include the rotary transformer 60 proximate to the top drive 40, as described above, or proximate to the drill floor 12. Indeed, in some embodiments, multiple rotary transformers 60 may be utilized on the same drilling rig 10.

Figure 2:
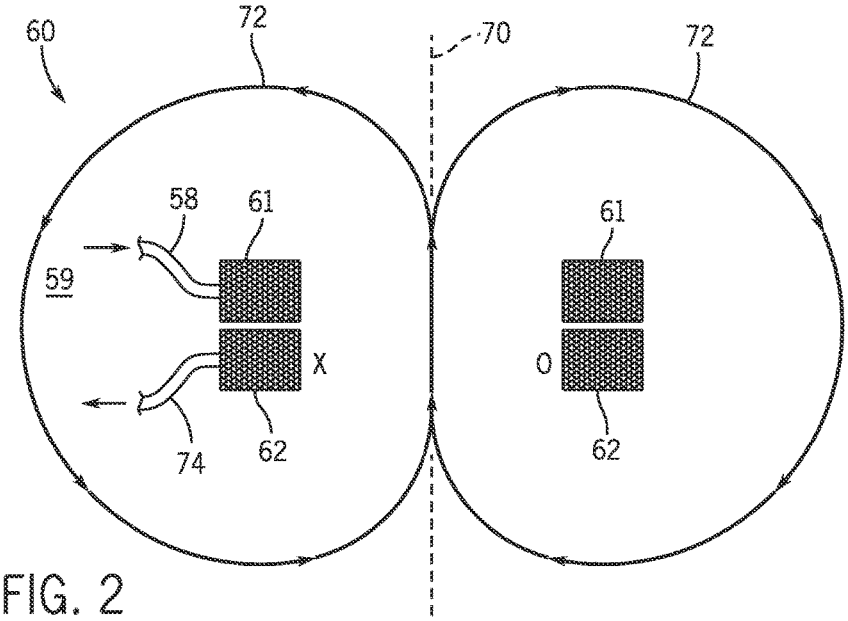
FIG. 2 is a cross-sectional schematic view of an embodiment of one rotary transformer of FIG. 1, in accordance with an aspect of the present disclosure.

To facilitate discussion, a cross-sectional schematic view of an embodiment of one rotary transformer 60 is shown in FIG. 2. The rotary transformer 60 includes the stationary component 61 (primary winding, stationary power input winding, stationary winding) and the rotating component 62 (secondary winding, rotating power input winding, rotating winding). The stationary component 61 and the rotating component 62 are radially centered on a longitudinal axis 70. Both components 61, 62 include coil wound annularly around the longitudinal axis 70. As shown, the stationary component 61 is coupled to the power source 59 via the electrical wiring 58, thereby enabling the power source 59 to provide the coil of the stationary component 61 with electric current. As the current travels through the stationary component 61 (e.g., annularly through the annular coil), magnetic flux (e.g., shown as arrows 72) is generated about the stationary component 61 and the rotating component 62 disposed below the stationary component 61, as previously described. The magnetic flux through the annular coil of the rotating component 62 enables induction of electric current in the coil of the rotating component 62. Further, the rotating component 62 includes power output wiring 74 coupled to the annular coil of the rotating components 62 that enables the rotating component 62 to provide power to rotating portions of the drill string (e.g., the saver sub 44, mud valve, or torque sensor).

Figure 3:
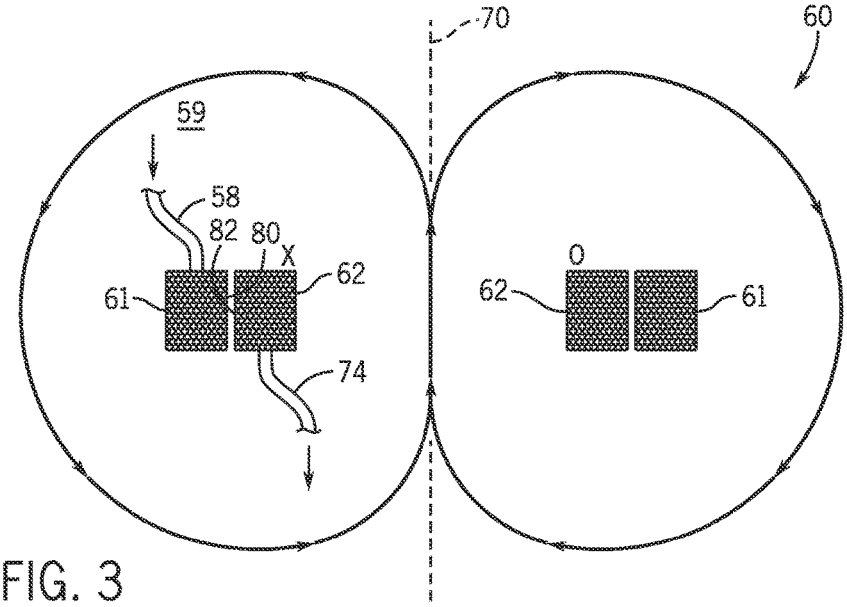
FIG. 3 is a cross-sectional schematic view of an embodiment of one rotary transformer of FIG. 1, in accordance with an aspect of the present disclosure.

It should be noted that, in some embodiments, the stationary and rotating components 61, 62 of the rotary transformer 60 may be relatively positioned in a different configuration than that of the embodiment illustrated in FIG. 2. For example, the stationary component 61 may be disposed below the rotating component 62. Alternatively, the stationary and rotating components 61, 62 of the rotary transformer 60 may be disposed in plane with each other with respect to the longitudinal axis 70. For example, as shown in a cross-sectional schematic view of an embodiment of the rotary transformer 60 in FIG. 3, the rotating component 62 may be disposed radially inside of the stationary component 61, where an inner diameter 80 of the stationary component 61 is larger than an outer diameter 82 of the rotating component 62. Further, in another embodiment, the stationary component 61 may be disposed radially inside of the rotating component 62.

Figure 4:
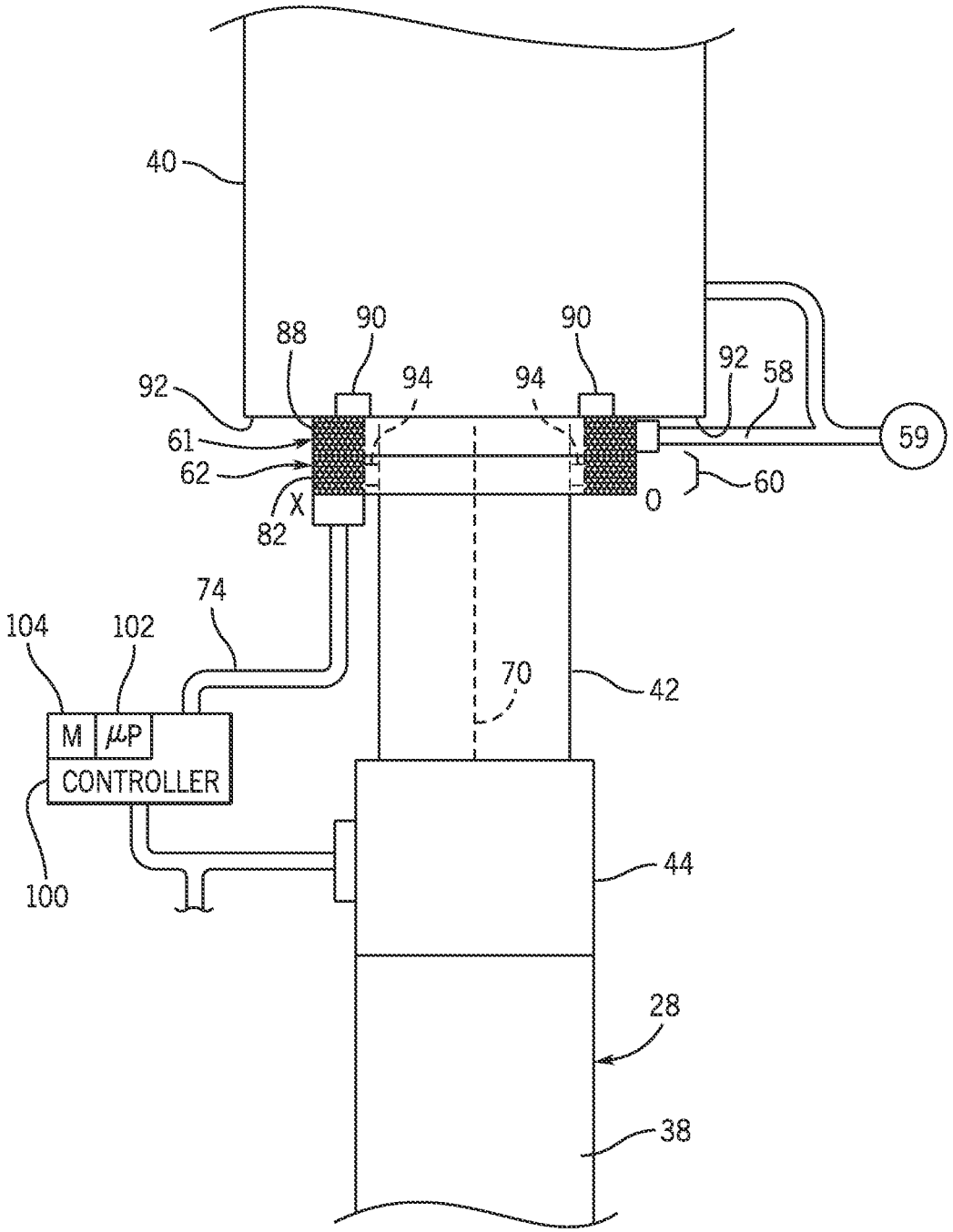
FIG. 4 is a side view of an embodiment of a top drive, drill string, and rotary transformer for use in the drilling rig of FIG. 1, in accordance with an aspect of the present disclosure.

As previously described, the rotary transformer 60, depending on the embodiment, may be positioned on or proximate to a number of components of the drilling rig 10. For example, a side view of an embodiment of the rotary transformer 60 positioned proximate to the top drive 40 and the quill 42 is shown in FIG. 4. It should be noted that a portion of the coils of the stationary and rotating components 61, 62 of the illustrated rotary transformer 60 are shown to facilitate discussion, but that the coils would normally wind annularly about the longitudinal axis 70 along outer perimeters 88, 82 of the stationary and rotating components 61, 62, respectively, and would be covered by a protective casing of the stationary and rotating components 61, 62, and, thus, would be hidden from view.

In the illustrated embodiment, the stationary component 61 is coupled to the electrical wiring 58, which extends between the stationary component 61 and the power source 59. Thus, the power source 59 provides an electric current to the stationary component 61 via the electrical wiring 58. The stationary component 61 of the rotary transformer 60 is also coupled to a stationary portion (e.g., a shroud) of the top drive 40. For example, fasteners 90 may couple the stationary component 61 to a bottom surface 92 of the top drive 40, such that the stationary component 61 is rigidly coupled to the top drive 40. In other embodiments, the stationary component 61 may be coupled to the top drive 40 via adhesive, clamps, clips, or some other coupling mechanism. As shown, the quill 42 extends from the top drive 40 (e.g., from a motor of the top drive 40) through the stationary component 61, and is not rigidly coupled to the stationary component 61. Accordingly, the quill 42 may rotate without rotating the stationary component 61 of the rotary transformer 60.

Further, the rotating component 62 of the rotary transformer 60 is disposed under the stationary component 61 and coupled to the quill 42. Generally, the rotating component 62 is not coupled to the stationary component 61 and does not physically contact the stationary component 61. For example, in the illustrated embodiment, the rotating component 62 is disposed below the stationary component 61 and is coupled to the quill 42 via fasteners 94. In other embodiments, the rotating component 62 may be coupled to the quill 42 via adhesive, clamps, clips, or some other coupling mechanism. It should be noted that, as previously described, the rotating component 62 may be disposed in-plane with the stationary component 62 (e.g., with respect to the longitudinal axis 70) in other embodiments. For example, in another embodiment, the rotating component 62 may be disposed radially inside the stationary component 61.

As previously described, the electrical wiring 58 provides an electric current from the power source 59 to the stationary component 61 of the rotary transformer 60. As the electric current travels through the coil of the stationary component 61, magnetic flux is generated through the middle of the annularly wound coils (e.g., proximate to longitudinal axis 70) of the stationary and rotating components 61, 62. Accordingly, the magnetic flux through the center of the annular coil of the rotating component 62 enables inductance of electric current in the annular coil of the rotating component 62. The electric power is transmitted from the rotating component 62 to other components of the drill string 28 via the power output wiring 74. For example, as shown, the power output wiring 74 enables transmission of electricity from the rotating component 62 of the rotary transformer 60 through a controller 100 and to the saver sub 44. The saver sub 44 may be a mud valve (e.g., a mud saver valve), which selectively enables and disables the transmission of mud, via a valve mechanism, through the top drive 40, through the quill 44, and to the drill string 28. Power provided to the saver sub 44 via the rotary transformer 60 may enable opening and closing the valve mechanism. The saver sub 44 may also include sensors configured to detect, for example, a torque in the drill string 28. The sensors may be powered by the rotary transformer 60 via the power output wiring 74 extending between the rotary transformer 60 and the sensors.

In the illustrated embodiment, the controller 100 may receive the power output wiring 74 and, thus, electric current from the rotating component 62. The controller 100 includes a processor, such as a microprocessor 102, and a memory device 104. The controller 100 may also include one or more storage devices and/or other suitable components. The processor 102 may be used to execute software, such as software for controlling power regulation from the rotating component 62 of the rotary transformer 60 to other components of the drilling rig 10 (e.g., components on the drill string 28). Moreover, the processor 102 may include multiple microprocessors, one or more "general-purpose" microprocessors, one or more special-purpose microprocessors, and/or one or more application specific integrated circuits (ASICS), or some combination thereof. For example, the processor 102 may include one or more reduced instruction set (RISC) processors and/or one or more complex instruction set (CISC).

The memory device 104 may include a volatile memory, such as random access memory (RAM), and/or a nonvolatile memory, such as ROM. The memory device 104 may store a variety of information and may be used for various purposes. For example, the memory device 104 may store processor-executable instructions (e.g., firmware or software) for the processor 102 to execute, such as instructions for controlling, for example, power regulation from the rotating component 62 and to other components on the drill string 28. The storage device(s) (e.g., nonvolatile storage) may include read-only memory (ROM), flash memory, a hard drive, or any other suitable optical, magnetic, or solid-state storage medium, or a combination thereof. The storage device(s) may store data or inputs (as described below), instructions (e.g., software or firmware for controlling power regulation). It should be noted that, as previously described, the rotary transformer 60 may be utilized for data transmission, and that the controller 100 may control data transmission to and from components on the drill string 28 and/or through the rotary transformer 60 to, for example, components of the control system 50 (as shown in FIG. 1). The controller 100 may control other aspects of the drill string 28, such as whether to open or close the valve mechanism of the saver sub 44. Further, it should be noted that, as previously described, the controller 100, the power output wiring 74, and the rotating component 62 all rotate with the drill string 28, as the rotating component 62 is rigidly attached to the drill string 28, the power output wiring 74, and the controller 100. Because the rotating component 62 of the rotary transformer 60 is not rigidly coupled to the stationary component 61 of the rotary transformer 60 (or, e.g., any other stationary component of the drilling rig 10), power is transmitted from the original power source 59 to, for example, the saver sub 44, via the rotary transformer 60, without wiring or other components becoming entangled as the drill string 28 rotates. Further, since the rotating component 62 does not physically contact the stationary component 61, frictional heat is reduced and the rotary transformer 60 may not generate sparks.

As previously described, the rotary transformer 60 may be utilized with the top drive 40 or with other components proximate to the top drive 40. For example, in another embodiment, a casing drive system 106 may be coupled to the top drive 40. The casing drive system 106 may supply casing to the wellbore 30 to reinforce the walls of the well 30. The casing drive system 106 may include a stationary portion that the stationary component 61 of the rotary transformer 60 is coupled to and a rotating portion that the rotating component 62 of the rotary transformer 60 may be coupled to. The rotary transformer 60 may power electric components of the casing drive system 106 itself (e.g., a sensor or controller), or the rotary transformer 60 may power other components of the drilling rig 10 (e.g., the drill string 28). Further, in another embodiment, a pipe handler 108 (e.g., a mechanism configured to pick up and lay down sections of tubular 38) may be coupled to or proximate to the top drive 40. The pipe handler 108 may include a stationary portion that the stationary component 61 of the rotary transformer 60 is coupled to and a rotating portion that the rotating component 62 of the rotary transformer 60 may be coupled to. The rotary transformer 60 may power electric components of the pipe handler 108 itself (e.g., a sensor or controller), or the rotary transformer 60 may power other components of the drilling rig 10 (e.g., the drill string 28). It should be noted that, in some embodiments, the rotating component 62 may be coupled to the quill 42 and the stationary component may be coupled to a stationary portion of the casing drive system 106 or the pipe handler 108.

Figure 5:
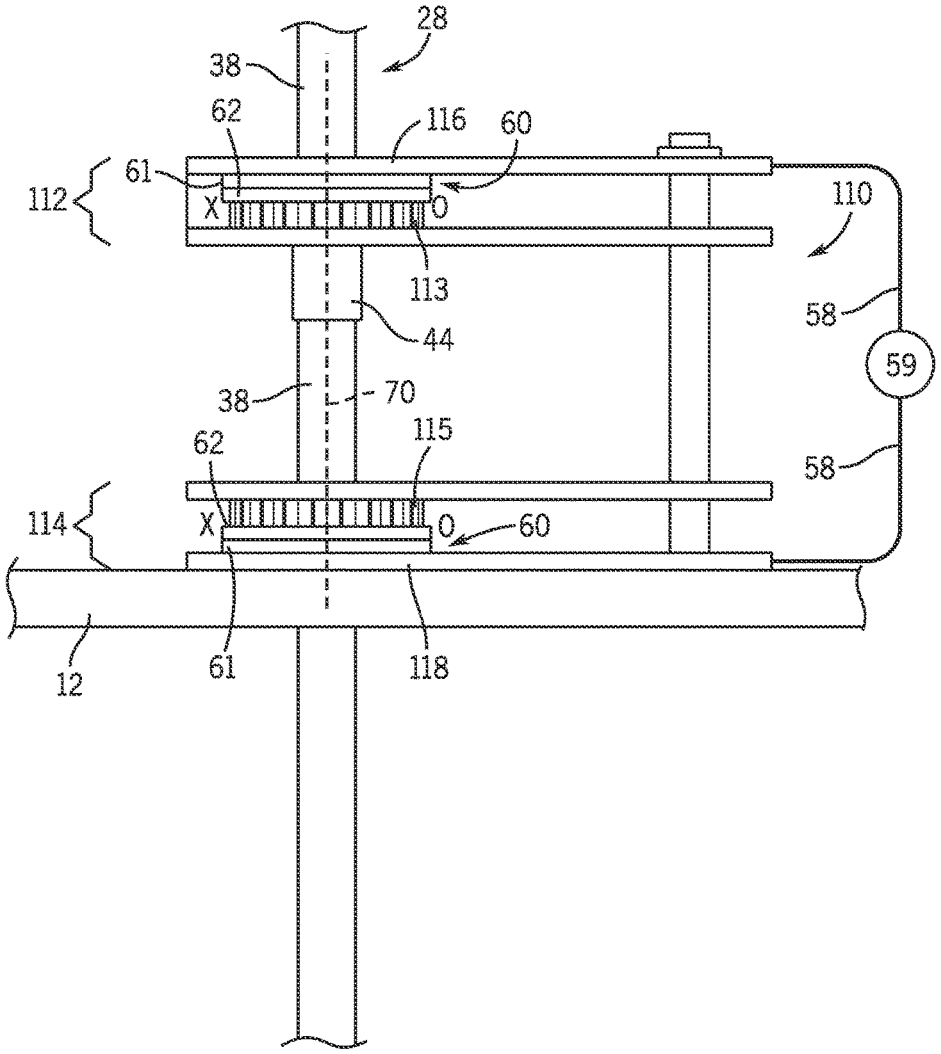
FIG. 5 is a side view of an embodiment of a differential speed disengage, a drill string, and rotary transformers for use in the drilling rig of FIG. 1, in accordance with an aspect of the present disclosure.

In even further embodiments, the rotary transformer 60 may be included on or proximate to the drill floor 12 of the drilling rig 10 or on different devices, as opposed to being included on or proximate to the top drive 40 of the drilling rig 10. For example, a side view of an embodiment of a differential speed disengage (DSD) or joint rotation system 110 is shown in FIG. 5. In the illustrated embodiment, the joint rotation system 110 is being utilized to disengage two sections of tubular 38 (e.g., upper and lower sections of tubular 38) coupled together via a saver sub 44. Generally, the joint rotation system 110 includes an upper rotation device 112 that engages with the upper section of tubular 38 (e.g., above the saver sub 44) via an upper gear 113 and a lower rotation device 114 that engages with the lower section of tubular 38 (e.g., below the saver sub 44) via a lower gear 115. The upper rotation device 112 may rotate the upper tubular 38 at a similar, or the same, rotational speed as provided by the top drive 40 (not shown) above the upper rotation device 112. The lower rotation device 114 may rotate the lower tubular 38 in the same direction, but at a faster speed than the upper rotation device 112 turns the upper tubular 38. Accordingly, the upper rotation device 112 acts as an anchor for the upper tubular 38 while the lower rotation device 114 rotates the lower tubular 38 to disengage the lower tubular 38 with the saver sub 44. By including the upper rotation device 112 (e.g., which acts as an anchor for the upper tubular 38), the difference in rotational speed (e.g., of the upper rotation device 112 and lower rotation device 114) enables all or most of the torque difference to be imparted on the engagement between the lower tubular 38 and the saver sub 44. For example, without the upper rotation device 112 rotating the upper tubular 38 at the same speed as imparted to the upper tubular 38 by the top drive 40, the torque applied to the lower tubular 38 by the lower rotation device 114 may propagate up the drill string 28 beyond the saver sub 44. Alternatively, if the upper rotation device 112 simply held the upper tubular 38 in place, the rotation of the upper tubular 38 via the top drive 40 may twist the drill string 28 below the top drive 40 (and above the upper rotation device 112), which may negatively impact the drill string 28.

It should be noted that, in some embodiments, one of the upper and lower rotation devices 112, 114 may engage with the saver sub 44 and the other of the upper and lower rotation devices 112, 114 may engage with either the upper section of tubular 38 or the lower section of tubular 38. Accordingly, in such embodiments, the joint rotation system 110 ensures that the saver sub 44 is disconnected from a desired one of the upper and lower sections of tubular 38 and remains coupled to a desired one of the upper and lower sections of tubular 38. For example, if the lower rotation device 112 engages the lower second of tubular 38 and the upper rotation device 114 engages the saver sub 44, the joint rotation system 110 ensures that the threaded connection between the saver sub 44 and the lower section of tubular 38 is disconnected, such that the saver sub 44 remains coupled to the upper section of tubular 38. Alternatively, the upper rotation device 114 may engage the upper section of tubular 38 and the lower rotation device 112 may engage the saver sub 44, ensuring that the joint rotation system 110 disconnects the threaded connection between the saver sub 44 and the upper section of tubular 38.

Figure 6:
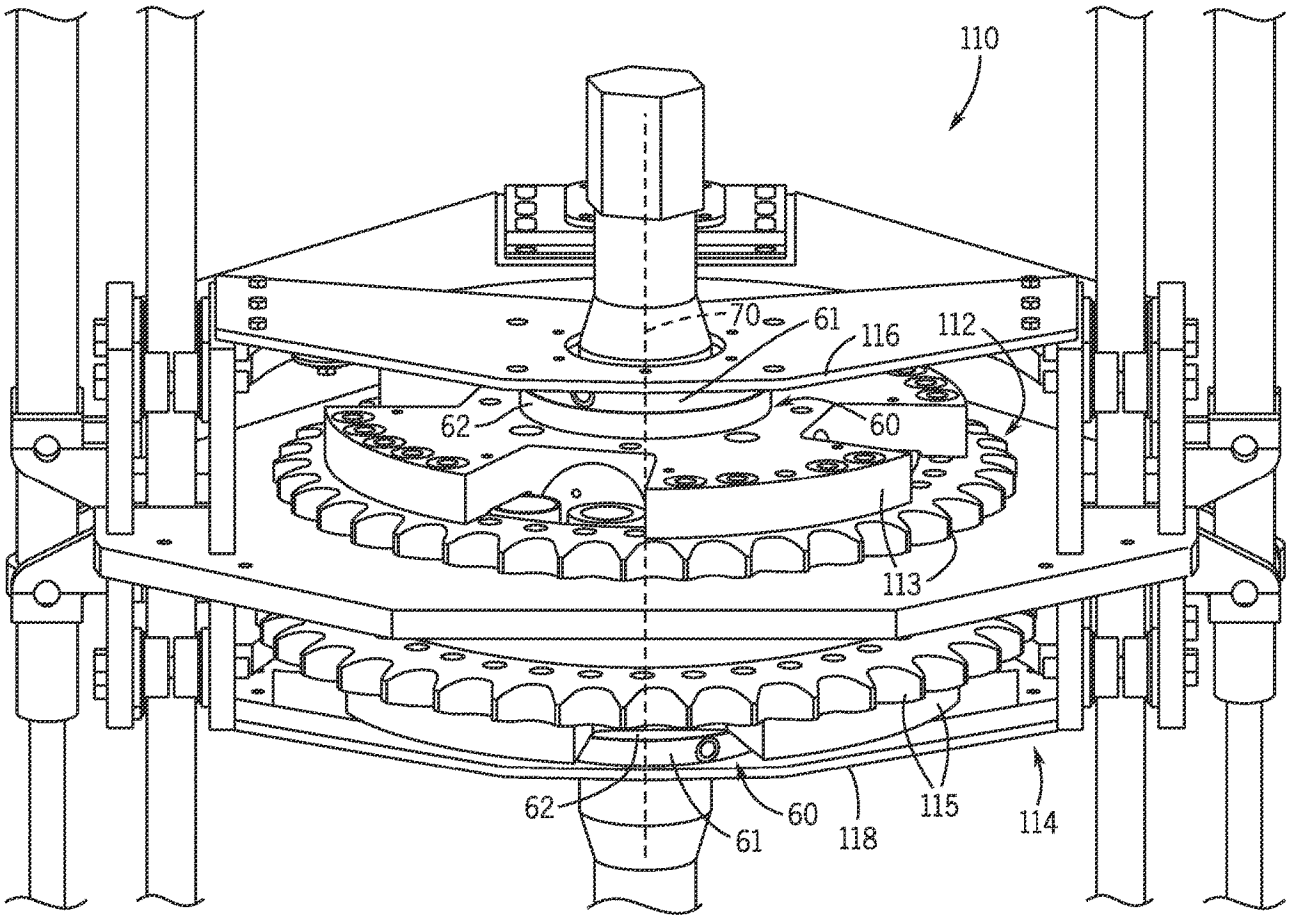
FIG. 6 is a perspective view of an embodiment of a differential speed disengage having rotary transformers for use in the drilling rig of FIG. 1, in accordance with an aspect of the present disclosure.
Figure 7:
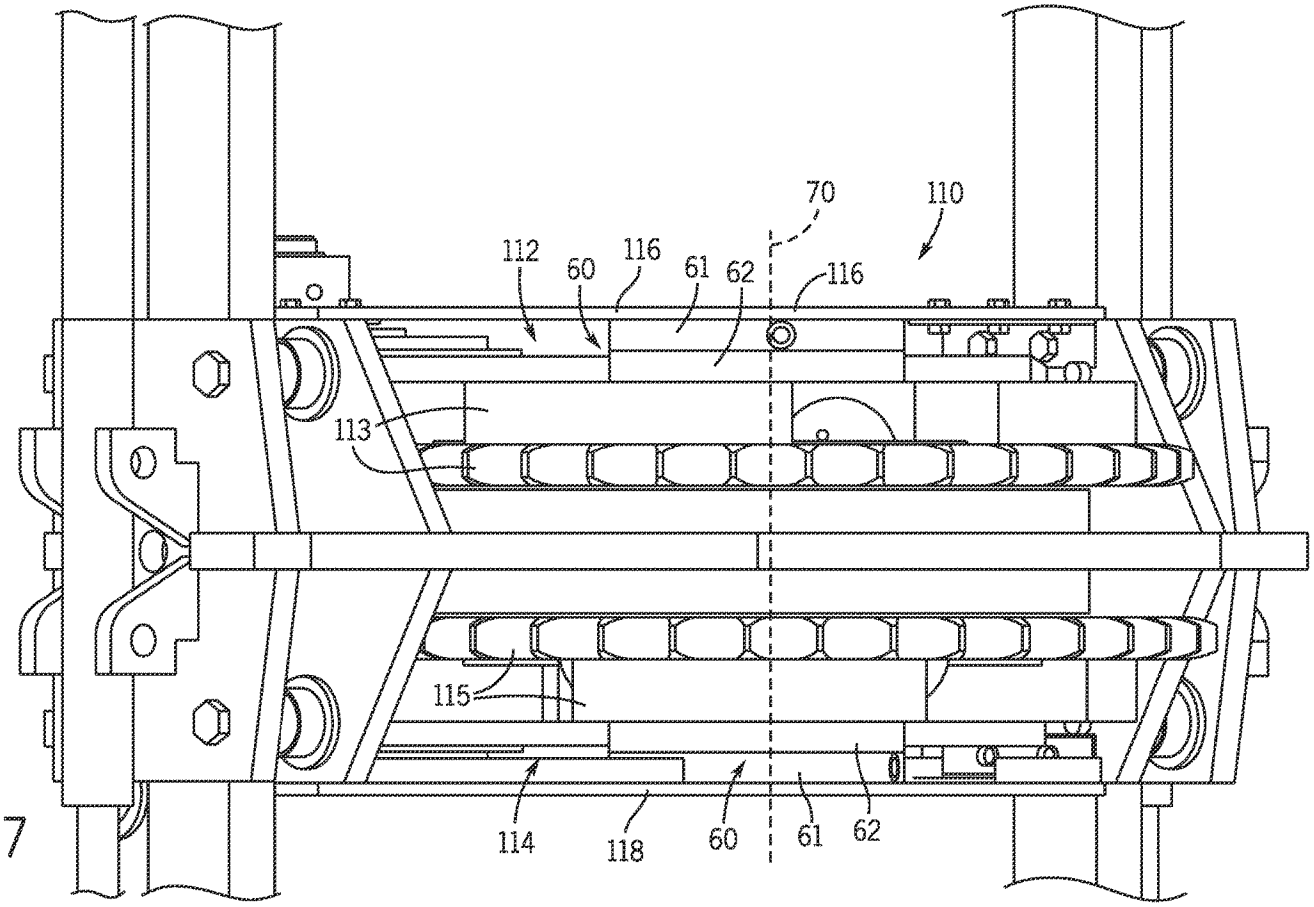
FIG. 7 is a perspective view of the differential speed disengage and rotary transformers of FIG. 6, in accordance with an aspect of the present disclosure.

In the illustrated embodiment, the joint rotation system 110 includes one rotary transformer 60 proximate to the upper rotation device 112 and one rotary transformer 60 proximate to the lower rotation device 114. The upper rotary transformer 60 includes the rotating component 62 coupled to the upper gear 113 (which rotates the upper tubular 38) and the stationary component 61 coupled to, for example, a stationary upper shroud 116 of the upper rotation device 112. The lower rotary transformer 60 includes the rotating component 62 coupled to the lower gear 115 (which rotates the lower tubular 38) and the stationary component 61 coupled to, for example, a stationary lower shroud 118 of the lower rotation device 114. As shown, the electrical wiring 58 that supplies electric current to the stationary components 61 of the rotary transformers 60 is fed through the upper and lower stationary shrouds 116, 118 of the upper and lower rotation devices 112, 114, respectively, and the electrical wiring 58 is coupled to the power source 59. Thus, the power source 59 supplies the electric current to the stationary components 61 of both rotary transformers 60, thereby generating the magnetic flux to induce the electric charge in the annular coils of the rotating components 62 of both rotary transformers 60. Although the output wiring is not shown, the rotating components 62 of the rotary transformers 60 may be electrically coupled to the rotating gears 113, 115 of the upper and lower rotation devices 112, 114, respectively, or to other rotating components of the drill string 28 to supply electric power to the components, as previously described. Perspective views of a similar embodiment of the joint rotation system 110 having two rotary transformers 60, one on each of the upper and lower rotation devices 112, 114, are shown in FIGS. 6 and 7. In FIGS. 6 and 7, the upper and lower rotation devices 112, 114 are disposed closer to one another than the embodiment shown in FIG. 5. It should be noted that the joint rotation system 110 and corresponding rotary transformers 60 may be similarly utilized during engagement of two sections of tubular 38, as opposed to disengagement of two sections of tubular 38 as described above.

As previously described, the rotary transformer 60 may be utilized with the drill floor 12 or with other components proximate to the drill floor 12 (e.g., the joint rotation system 110 described above). For example, in another embodiment, the iron rough neck 39 may be coupled to or disposed proximate to the drill floor 12. The iron rough neck 39 may be utilized in a similar manner as the joint rotation system 110 to engage or disengage various portions of the drill string 28. The iron rough neck 39 may include a stationary portion (e.g., a shroud) that the stationary component 61 of the rotary transformer 60 is coupled to and a rotating portion that the rotating component 62 of the rotary transformer 60 may be coupled to. Further, in another embodiment, power tongs may be coupled to or disposed proximate to the drill floor 12. The power tongs may include a stationary portion (e.g., a shroud) that the stationary component 61 of the rotary transformer 60 is coupled to and a rotating portion that the rotating component 62 of the rotary transformer 60 may be coupled to. In general, the rotary transformer 60 may be coupled with or proximate to any suitable component of the drilling rig 10 between or just proximate to the top drive 40 and the drill floor 12 that includes a rotating portion and a stationary portion. Further, in some embodiments, the stationary component 61 of the rotary transformer 60 may be coupled to a stationary portion of a first component (e.g., the top drive 40), and the rotating component 62 of the rotary transformer 60 may be coupled to a rotating portion of a second component (e.g., the quill 42). In other words, both components 61, 62 of the rotary transformer 60 may not be coupled to the same component or system in all embodiments, but may be coupled to different components or systems.

Further, it should be noted that, in some embodiments, the stationary component 61 may be coupled to a component of the drilling rig 10 that rotates slightly, causing the stationary component 61 to rotate slightly, but not to the extent of the rotating component 62. For example, the stationary component 61 may be coupled to a portion of the drilling rig 10 that alternates clockwise and counterclockwise rotations of, for example, 0-180 degrees. Although the component rotates back and forth, the component does not rotate enough to entangle wires or other features coupled to the stationary component 61. Thus, the term "stationary" is a relative term, and does not limit the stationary component 61, in accordance with the present disclosure, to a component that never moves or that is absolutely stationary. Indeed, the stationary component 61 may move linearly with components of the drilling rig 10 (e.g., with the drill string 28), or the stationary component 61 may rotate slightly to accommodate rotation of the component to which the stationary component 61 is fixed. However, in general, the rotating component 62 is coupled to a portion of the drilling rig 10 that utilizes electric power but cannot couple to a stationary power source because of the risk of entangled wires. Further, in general, the rotating component 62 is coupled to a portion of the drilling rig 10 that, at the very least, is expected to rotate more than any component the stationary component 61 is coupled to.

Figure 8:
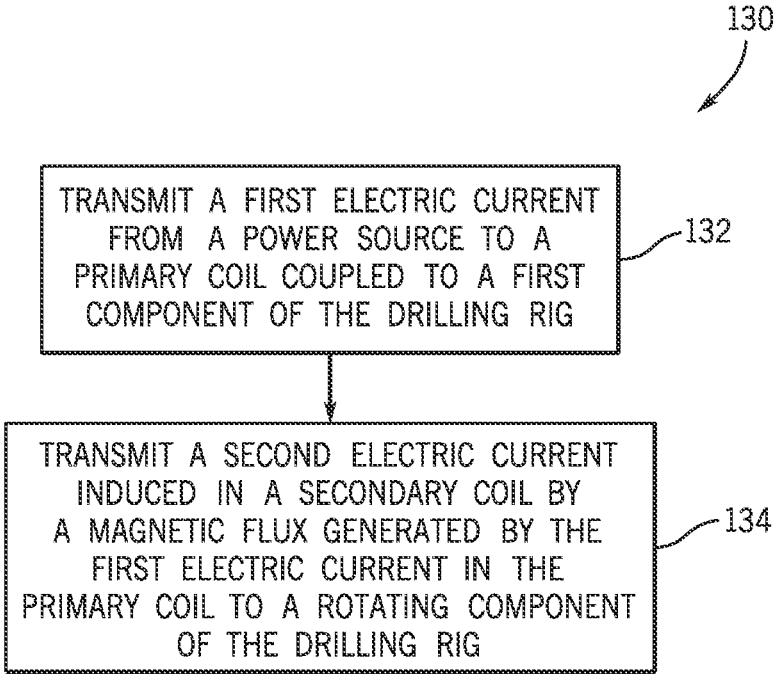
FIG. 8 is a process flow diagram of an embodiment of a method of transmitting power for use in the drilling rig of FIG. 1, in accordance with an aspect of the present disclosure.

Turning now to FIG. 8, a process flow diagram of a method 130 of transmitting power on a drilling rig 10 is shown. In the illustrated embodiment, the method 130 includes transmitting a first electric current from a power source 59 to a stationary component 61 of a rotary transformer 60 (block 132), where the stationary component 61 is coupled to a first component (e.g., the top drive 40) of the drilling rig 10.

The method 130 further includes transmitting a second electric current from a rotating component 62 of the rotary transformer 60 to a rotating component (e.g., the quill 42, the saver sub 44, or the controller 100) of the drilling rig 10, where the second electric current is induced in the rotating component 62 of the rotary transformer 60 by a magnetic flux through the rotating component 62 of the rotary transformer 60 that is generated by the first electric current in the stationary component 61 (block 134). For example, as previously described, the first electric current through the stationary component 61 of the rotary transformer 60 generates the magnetic flux through the stationary component 61 and the rotating component 62. The magnetic flux through the rotating component 62 induces the second electric current in the rotating component 62. The second electric current is then transmitted to the rotating component of the drilling rig 10 coupled to the rotating component 62 of the rotary transformer 60. In some embodiments, the second electric current may be transmitted to a different rotating component of the drilling rig 10 than the rotating component coupled to the rotating component 62 of the rotary transformer 60. For example, the rotating component of the drilling rig 10 configured to receive the second electric current from the rotating component 62 of the rotary transformer 60 may be the quill 42, the saver sub 44, or the controller 100.

As previously described, in accordance with present embodiments, the rotary transformer 60 enables power transmission from a relatively stationary power source to rotating components of the drilling rig 10 (e.g., on or proximate to the drill string 28). The rotary transformer 60 enables such power transmission without tangling wires. Further, the rotary transformer 60 enables such power transmission without rigid contact between stationary and rotating components of the rotary transformer 60 and power system. Accordingly, frictional heat is reduced and sparking is blocked.

While only certain features have been illustrated and described herein, many modifications and changes will occur to those skilled in the art. It is, therefore, to be understood that the appended claims are intended to cover all such modifications and changes as fall within the true spirit of the invention.

The invention claimed is:

1. A drilling system, comprising:

a drill string actuation mechanism having a longitudinal axis, a first component, and a second component downstream of the first component with respect to a direction of drilling, wherein the second component is configured to be rotated about the longitudinal axis relative to the first component by a driving mechanism of the drill string actuation mechanism;

a saver sub coupled to the second component or a third component downstream from the second component with respect to the direction of drilling, wherein the saver sub comprises a mud valve; and a rotary transformer having a power input winding and a power output winding, wherein the power input winding is configured to be coupled to a power source and to the first component of the drill string actuation mechanism, wherein the power output winding is configured to be coupled to the second component of the drill string actuation mechanism, and wherein the power output winding is electrically coupled with, and configured to provide electric power to, the mud valve.

2. The system of claim 1, comprising a top drive, wherein the drill string actuation mechanism includes or is proximate to the top drive.

3. The system of claim 2, wherein the drill string actuation mechanism comprises a casing drive system having at least one of the first component and the second component.

4. The system of claim 1, wherein the first component of the drill string actuation mechanism comprises a top drive and the second component of the drill string actuation mechanism comprises a quill coupled to the top drive.

5. The system of claim 1, wherein the drill string actuation mechanism comprises a pipe handler including features corresponding to at least one of the first component or the second component.

6. The system of claim 1, comprising a drill floor, wherein the drill string actuation mechanism is proximate to the drill floor.

7. The system of claim 6, wherein the drill floor is the first component.

8. The system of claim 1, wherein the drill string actuation mechanism comprises a differential speed disengage including features corresponding to at least one of the first component and the second component.

9. The system of claim 1, wherein the drill string actuation mechanism comprises an iron roughneck including features corresponding to at least one of the first component and the second component.

10. The system of claim 1, wherein the rotary transformer is configured to transfer electric power and data from the power input winding to the power output winding via a magnetic flux generated by electric current provided to the power input winding via the power source.

11. The system of claim 1, wherein the first component is configured to oscillate about the longitudinal axis of the drill string actuation mechanism, such that the first component and the second component are configured to rotate about the longitudinal axis at different rates.

12. A power transmission system for a drilling rig, comprising:

a rotary transformer;

an input winding of the rotary transformer coupled to a first component of a drill string actuator of the drilling rig;

an output winding of the rotary transformer coupled to a second component of the drill string actuator, wherein the second component is configured to be rotated about a longitudinal axis of the drill string actuator wherein the input winding of the rotary transformer is configured to electrically couple with a power source to receive a first electric current and generate a magnetic flux through the output winding to induce a second electric current in the output winding without physical contact between the input winding and the output winding; and a mud valve electrically coupled to the power output winding, wherein the rotary transformer is configured to transfer electric power to the mud valve via the power output winding to selectively enable or disable fluid circulation through the mud valve.

13. The power transmission system of claim 12, wherein the input winding and the output winding are disposed in plane with respect to the longitudinal axis or are axially staggered with respect to the longitudinal axis.

14. The power transmission system of claim 12, wherein the rotary transformer is disposed proximate to a top drive of the drilling rig, wherein the first component of the drill string actuator comprises a first portion of the top drive and the second component of the drill string actuator comprises a sub driven by a quill of the top drive.

15. The power transmission system of claim 12, wherein the rotary transformer is disposed proximate to a drill floor of the drilling rig, wherein the second component of the drill string actuator comprises a first portion of the drill floor, a first portion of a differential speed disengage, a first portion of power tongs, or a first portion of an iron rough neck, and the second component of the drill string actuator comprises a second portion of the differential speed disengage, a second portion of the iron rough neck, or a second portion of the power tongs.

16. The power transmission system of claim 12, wherein the rotary transformer is configured to transfer electric power and data from the input winding to the output winding, and the output winding is configured to provide the electric power and data to a saver sub, a wireless torque turn sensor, or both.

17. The power transmission system of claim 12, wherein the first component is configured to oscillate relative to the second component, such that the first component and the second component are configured to rotate about the longitudinal axis.

18. A method for providing power to a component on a drilling rig, comprising:

transmitting a first electric current from a power source to a primary coil coupled to a first component of the drilling rig to generate a magnetic flux through the primary coil and through a secondary coil, wherein the secondary coil is disposed proximate to the primary coil and coupled to a second component of the drilling rig, wherein the second component is configured to rotate relative to the first component, and wherein the magnetic flux through the secondary coil induces a second electric current in the secondary coil;

transmitting the second electric current from the secondary coil to the second component or to a third component configured to rotate with the second component; and actuating a mud valve at or coupled to the second component or the third component using the second electric current, wherein the actuation of the mud valve is configured to enable or disable a flow of fluid through the first component, the second component, the third component, or any combination thereof.

19. The method of claim 18, comprising transmitting data from the primary coil to the secondary coil, from the secondary coil to the primary coil, or both.

20. The method of claim 18, wherein the first component is a top drive, the second component is a quill or a saver sub, or the third component is the quill or the saver sub.

* * * * *